United States Patent [19]

Pichon et al.

[11] Patent Number: 4,514,038

[45] Date of Patent: Apr. 30, 1985

[54] OPTICAL FOURIER TRANSFORMER DEVICE AND OPTICAL CORRELATOR INCORPORATING THE SAID DEVICE

[75] Inventors: Laurence Pichon; Jean P. Huignard, both of Paris, France

[73] Assignee: Thomson-CSF, Paris, France

[21] Appl. No.: 345,018

[22] Filed: Feb. 2, 1982

[30] Foreign Application Priority Data

Feb. 6, 1981 [FR] France ..... 81 02410

[51] Int. Cl.[3] ..... G06G 9/00

[52] U.S. Cl. ..... 350/162.13; 350/162.14; 364/822

[58] Field of Search ..... 350/162.12, 162.13, 350/162.14; 364/822

[56] References Cited

FOREIGN PATENT DOCUMENTS 2362466 3/1978 France .
2468947 5/1981 France .

OTHER PUBLICATIONS

*Applied Optics,* vol. 15, No. 6, Jun. 1976, by: S. Iwasa: "Optical Processing: A Near Real-Time Coherent System Using Two Itek PROM Devices", pp. 1418–1429.
*Applied Optics,* vol. 15, No. 11, Nov. 1975; by P. Nisenson et al: "Real-Time Optical Correlation", pp. 2602–2606.
*Proceedings of the IEEE,* vol. 65, No. 1, Jan. 1977, by: B. J. Thompson: "Hybrid Processing Systems—An Assessement", pp. 62–76.

*Primary Examiner*—Bruce Y. Arnold
*Attorney, Agent, or Firm*—Oblon, Fisher, Spivak, McClelland & Maier

[57] ABSTRACT

This optical Fourier transformer device supplying the correlation function of two motifs of an object illuminated in coherent light by using the double diffraction principle is essentially characterized in that it generates a complex wave conjugate of a wave modulated by the object propagating in the opposite direction to the latter. This conjugate wave is produced by double diffraction in an interaction medium and compensates the distortions induced by the optical components of the system. The optical correlator system utilizing this Fourier transformer is essentially characterized in that it uses a recyclable material as the recording medium. A reading beam is subject to an angular scan making it possible to optimize the diffraction efficiency of this medium. The beam modulated by the object and the reading beam are synchronously deflected to improve the signal to noise ratio in the output plane.

8 Claims, 5 Drawing Figures

OPTICAL FOURIER TRANSFORMER DEVICE AND OPTICAL CORRELATOR INCORPORATING THE SAID DEVICE

BACKGROUND OF THE INVENTION

The invention relates to the field of optical correlation making it possible to obtain the correlation function of one image with another. For example such systems make it possible to recognize a graphic in a given motif.

A known optical correlator system is described in French Patent Application No. 2 648 947 published on May 5th 1981. A recording is made on a photosensitive support of a system of interference fringes representing the diffraction pattern obtained from two parallel coherent beams on whose path have been interposed two objects having non-uniform transparency after focusing by a lens. This photosensitive support is read by one of the beams and in the focal plane of a second lens is obtained an intensity distribution characteristic of the correlation product between the two objects. When a graphic is to be found in a given motif, the image obtained is formed by peaks indicating the presence and position of this graphic in the motif in question. In the patent application referred to above the photosensitive support is a continuously recyclable medium, i.e. which can be inscribed or written without development and which can be erased at random. However, in such a system there are parasitic phase distortions induced by the optical components and, for the introduction of data, by photographic transparencies or electro-optical transducers. It is also known to interpose on the propagation of the waves a transparency, whose phase characteristic permits a strict compensation of the incident wave surface distortions. The filter is positioned in the Fourier plane, so that it can still be used no matter what the translation of the tranparency in the object plane.

The Fourier transformer system according to the invention compensates these distortions in a simpler manner. This system uses a wave front conjugate to the incident wave front which, at any point, is isomorphic to the latter. This conjugate wave front is, by inverse return, modulated a second time by the object. However, as a result of the reverse path, there is a compensation of the modulation deformations of the outward path. The same applies regarding deformations due to abberations of the lens, i.e. they are compensated.

The optical correlator system including the Fourier transformer system allows a significant gain to be obtained on the signal to noise ratio of the correlation peak. The latter is made equivalent to that resulting from an incoherent illumination.

By displacing the point source along a line segment an incoherent integration takes place in the image plane of the coherent images, whose noises are decorrelated. An electro-optical cell also may be interposed on the passage of the beam, which permits a translation of the cell. The low frequencies of the spectrum of the object transparency are attenuated by merely chosing the ratio of the different beams. Thus, this system makes it possible to process in parallel and in real time a large amount of data with less expensive optical components.

BRIEF SUMMARY OF THE INVENTION

The present invention relates to an optical Fourier transformer device comprising a coherent radiation point source located at the focus of a convergent line, means for positioning a modulating object in the collimating beam emerging from said lens, and optical means illuminating a plane by a distribution of Fourier transformed light amplitudes of the optical modulation produced by said object, these optical means comprising a photoexcitable interaction medium with index variation receiving the collimated beam via said object and a pumping beam from said source, a plane reflector arranged so as to reflect in normal incidence and towards the said medium the radiation incident thereon, a semitransparent plate positioned between the said source and said lens for reflecting towards said plane reflector the radiation contained in the conjugate wave re-radiated by said medium in the direction of said lens.

The invention also relates to a double diffraction optical correlator comprising a a first Fourier transformer, a photoexcitable interaction medium having an index refraction variation arranged so as to simulaneously receive the radiation emerging from the first transformer and another radiation contained in a reference beam and a second Fourier transformer for projecting into an image plane illumination representing the correlation function of two modulating objects introduced into the first Fourier transformer device, the latter being an optical Fourier transformer device as described above.

BRIEF DESCRIPTION OF THE DRAWINGS

The invention is described in greater detail hereinafter relative to non-limitative embodiments and the attached drawings, in which.

DETAILED DESCRIPTION OF THE PREFERRED EMBODIMENTS

The system according to the invention utilizes the restoration of a wave front of complex morphology emerging from a modulating object generated by the interference in an interaction medium of an incident optical object wave with a pumping wave.

Figure 1:
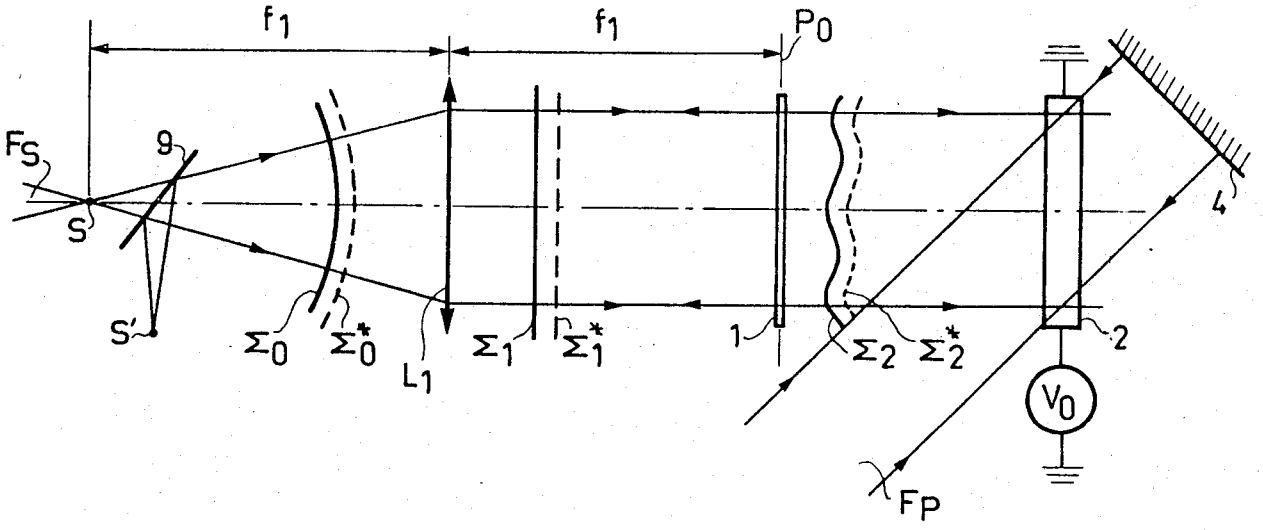
FIG. 1 is a basic diagram of the operation of the Fourier transformer used in the device according to the invention.

In FIG. 1 this interference takes place in a three-dimensional photoexcitable interaction medium 2 housing an index of refraction variation, whose physical characteristics (in particular, refractive index) are spatially modulated by a system of fringes from the incident wave of wave front $\Sigma_2$ and from the pumping wave $F_P$.

Due to the existence of this spatial modulation, a fraction of the pumping wave energy is diffracted in the form of an emergent wave. Another fraction of the energy traverses medium 2 and is returned to the medium by a plane reflector 4 positioned perpendicular to its path. Part of its energy is then diffracted by the ruled grating inscribed in the medium in the form of an emergent wave from the complex wave front $\Sigma_2^*$ conjugate with wave $\Sigma_2$. $\Sigma_2^*$ has characteristics which are isomorphic of those of $\Sigma_2$ and follows the same optical path, but in the opposite direction. $\Sigma_2^*$ returns to the object from which $\Sigma_2$ emanates. The restoration of wave $\Sigma_2^*$ takes place in real time, ignoring the establishment time $\tau$ for the ruled grating, which can vary from $10^{-3}$ to $10^{-12}$ seconds. Variations can be induced in it by varying the incident wave, but they must be slow compared with the time constant $\tau$. For example the interactive medium 2 is formed by a photoconductive electro-optical material such as bismuth silicon oxide (BSO). It could also be an oxide such as bismuth germanium oxide (BGO). These two oxides are particularly suitable for the present invention because they are very sensitive to the wavelength range currently used and which constitutes the visible light wave range. Moreover it is possible to obtain monocrystals of adequate size having good optical characteristics. This medium is polarized at voltage Vo.

Incident wave $\Sigma_2$ comes from a beam which has been collimated by spherical lens $L_1$ from a point source S. Thus, the wave front which is $\Sigma_0$ (spherically divergent) becomes $\Sigma_1$ collimated. The light beam collimated by lens $L_1$ is then modulated by the non-linearly transparent object 1 located in the focal plane Po of the lens or in the object plane. Thus, during the return path of wave fronts $\Sigma_2$* the beam is focused at an image point S' of S after reflection by a semitransparent plate 9.

The outward path across lens $L_1$ and object 1 produces parasitic phase distortions of waves $\Sigma_1$ and $\Sigma_2$. These distortions are due to aberrations of lens $L_1$ and to relative deformations of the object with respect to the support. The return path across the same object and lens make it possible to compensate these defects due to a parasitic phase modulation of the wave fronts. It also makes it possible to double the contrast of the amplitude modulation due to the objects.

An amplitude distribution proportional to the Fourier transform of the amplitude distribution in the object plane Po takes place in the focal plane of lens $L_1$ in which is located the image of S after reflection on to the semitransparent plate 9. Thus, a Fourier transform of the optical modulation produced by object 1 is obtained.

Figure 2:
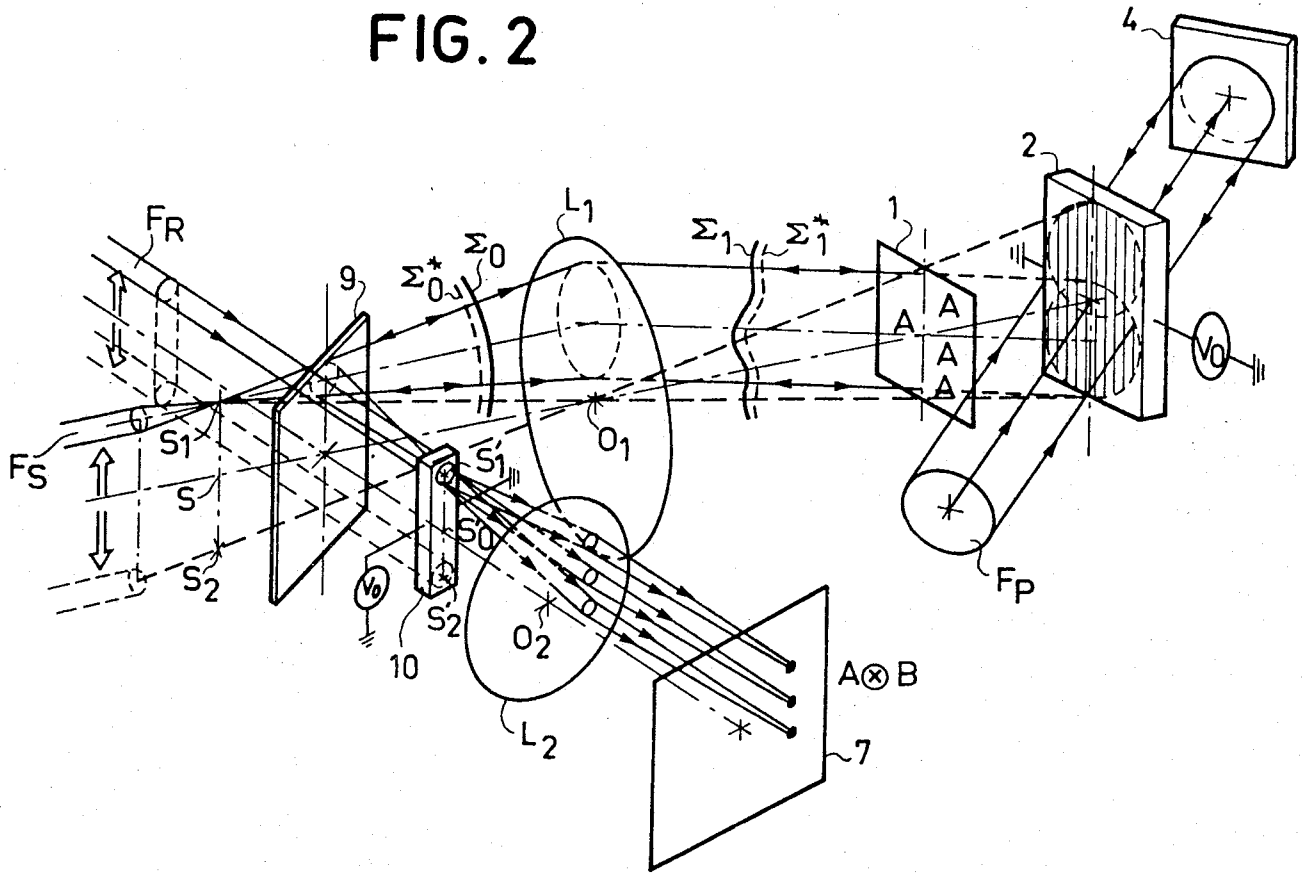
FIG. 2 is the diagram of an embodiment of the system according to the invention.

In FIG. 2 the system described in FIG. 1 is retained. The same components of the system of FIG. 1 are once again used. To these are added a photosensitive medium 10 in the plane of image point S' perpendicular to the direction of the rays passing through the optical centres. This plane is the focal plane of a lens $L_2$, whose other focal plane is constituted by the detector medium 7.

Figure 3:
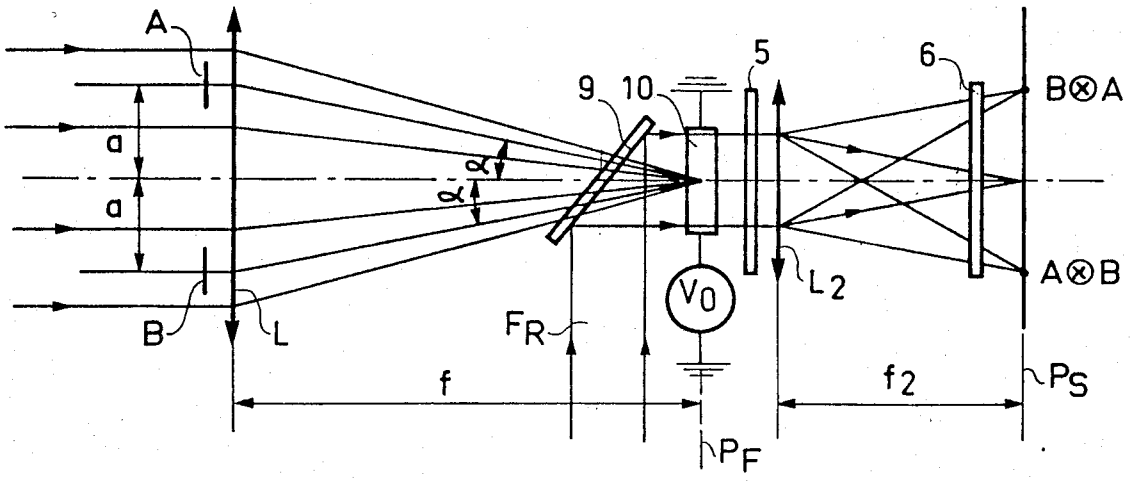
FIG. 3 is an explanatory diagram of the optical correlator used in the device according to the invention.

Reference is made to FIG. 3 for providing an understanding of the principle of optical correlation. After being modulated by an object transparency constituted by two motifs A and B, a parallel ray is focused by a spherical lens L within an interaction medium 10 located in the focal plane of the latter. The algebraic sum of the Fourier transforms is recorded in this medium, i.e. the spectra of two bidimensional functions representing the transmittances of two object motifs A and B. Thus, said medium is located in the focal plane of L or Fourier plane, and the amplitude distribution is proportional to the Fourier transform of the amplitude distribution of the object plane. As in the time signal spectrum, the spectra of the spatial signals are symmetrical with respect to zero frequency. However, this is a symmetry in the plane and no longer only on an axis. On translating the object transparency of $\Delta x$ in an object plane, the spectrum remains unchanged in the Fourier plane, the Fourier transform being invariant in translation.

There are no amplitude differences, but there is a phase displacement of form $e^{i\Delta x}$ leading to a displacement in the image plane or output plane Ps. Thus, in our case little importance is attached to the position of the object motifs A and B in the object plane, their resultant spectrum corresponding to the superimposing of each of their spectra at the same point. Thus, medium 10 records the superimposing of fringes with different spacings, the average spacing being equal to $(\lambda 1)/(2 \sin \alpha)$ in which $\lambda_1$ is the optical wavelength of the incident beams which interfere and $\alpha$ is the half angle between the beams. The interference fringes resulting from the superimposing of these beams illuminating A and B, after the focusing effected by lens L, are therefore recorded in an interaction medium 10 constituted, for example, by an electro-optical material polarized by an electrical field obtained by means of a voltage source Vo. Its orientation is such that the electrical field produces a transverse electrooptical effect. The spatial variations of light intensity existing in plane $P_F$ instantaneously lead to spatial variations of the refractive index of plate. These interference planes are quasi-perpendicular to the direction of the electrical field applied. The index modulation disappears with the disappearance of the object motifs A and B on the path of the beams.

Thus, there is a randomly erasable real time inscription. To obtain any information with a maximum of resolution, it is necessary for the thickness of the crystal to be equal to or greater than the width of the diffractive area. It is possible to define a thickness which is significantly greater than the wavelength of the beams, so that the recording in the plate can be considered as three-dimensional. This involves a superimposing of surface networks. When the width of the plate is not too great, these surfaces can be likened to planes perpendicular to the plane of the drawing. Their spacing p and slope $\phi$ with respect to an axis perpendicular to plane $P_F$ and in the plane of the drawing are dependent on the angle of the interfering rays, their wavelength $\lambda_1$ and the refractive index n of crystal 10. The materials which can be used must be photosensitive and electro-optical, such as bismuth silicon oxide or bismuth germanium oxide. Once the recording has been made on the photosensitive support, reading takes place by means of a coherent parallel beam $F_R$ illuminating the support under normal incidence. To obtain an optimum efficiency in one of the orders, there is an angle between reading beam $F_R$ and the diffraction planes defined by the Bragg condition. In this case the various recorded networks diffract beam $F_R$ according to angles $\theta$, such that $\sin \theta = (\lambda 2/2p)$ in which p is the spacing of the fringe plane network and $\lambda_2$ the wavelength of the beam $F_R$. This condition cannot be realized for all the systems which are superimposed and the invention also provides for an angular scanning of the reading beam $F_R$. For example, the latter is a low power laser with a wavelength which is chosen outside the wavelengths to which the material forming medium 10 is sensitive. Beam $F_R$ is, for example, deflected by a conventional acosto-optical or mechanical deflector. It is in this case returned in the direction of medium 10 by a semitransparent plate. Thus, at any time and for a given orientation of beam $F_R$, only the points located on a straight line (perpendicular to the plane of the drawing and with which it is possible to associate a slope $\phi$ and a spacing p of the plane networks in crystal 10 for which the incidence $\theta$ of the beam relative to the plane is the Bragg incidence) can be obtained with a maximum efficiency. The adjacent points for which the incidence is in a range $\delta\phi = np/d$ in which n is the refractive index of the medium and d the thickness of the useful diffraction area of the medium are obtained with a reduced efficiency. Thus, all the correlation peaks appear sequentially.

Thus, a parallel beam emerges, which is focused by a second spherical lens $L_2$ at a point of the image plane or output plane $P_S$. This plane is the focal plane of lens $L_2$. This makes it possible to generate a new Fourier transformation, which makes it possible to obtain a filtered image by optical correlation. It is, in fact, the Fourier transform of the algebraic sum of two Fourier transforms of functions representing the transmittance of A and B. Thus, it possible to pass back into the initial speed. The correlation of one signal by another can be broken down into two correlations, namely an autocorrelation function of the signal to be observed and a correlation function of the signals by the noise. The autocorrelation function is a symmetrical function having the configuration of a peak. In this case there is a radiation which is not diffracted at the centre and two peaks of symmetrical correlations with respect to said centre. In our case a correlation peak is a light focusing point in the output plane. The correlation function of the signal by the noise represents an expanded background from which emerge a few secondary peaks, but whose amplitude is below that of the autocorrelation peaks.

The parallel reading beam $F_R$ can have a wavelength $\lambda_1$ differing from that $\lambda_1$ of the source beam, which is modulated by A and B. A coloured filter 5 is then inserted between the medium 10 and lens $L_2$, so that it only permits the passage of the part of the emergent beam of wavelength $\lambda_2$. Thus, it is necessary to eliminate the part of the emergent beam of wavelength $\lambda_1$.

The beam emergent from interaction medium 10 has undergone a reflection on the interference lines of this medium. This wave beam consequently has a horizontal polarization. The interference lines are in fact perpendicular to the direction of the applied field. On inserting a polarizer 6 in the emergent beam, a better signal to noise ratio is obtained.

FIG. 2 has all the components considered in FIG. 3. The beam modulated by the object motifs A and B is the conjugate return beam emerging from medium 2, which then traverses lens $L_1$. Thus, lens $L_1$ of FIG. 2 corresponds to lens L of FIG. 3. The device of FIG. 2 makes it possible to perform an optical correlation. It incorporates the Fourier transformer of FIG. 1. The return beam of wave front $\Sigma_0$* reflected on the semitransparent plate is a beam modulated in amplitude by object 1 comprising motifs A and B in FIG. 3. There is a compensation of the phase distortions obtained by the real time generation of the conjugate wave front in medium 2. Compensation also takes place of the aberrations of lens $L_1$ effecting the Fourier transform and of distortions induced by the data introduction device, which in this case functions by transmission. The discriminating power in the source plane of the correlator is low. Speckle occurs due to the use of coherent light. Averaging takes place by superimposing the intensities of a certain number of images to improve the signal to noise ratio. Each image is obtained with an identical object transparency, but with a different speckle shape.

As shown in FIG. 2, this averaging can be carried out by displacing source beam $F_S$ along a line segment $S_1S_2$, by the reference beam $F_R$ being synchronously displaced to strike medium 10 at the same point as the source beam between $S'_1$ and $S'_2$. These displacements may be obtained by any acousto-optical or electro-optical deflection device, or even by way of a mechanical displacement of a lens or optical fibre end.

Figure 4:
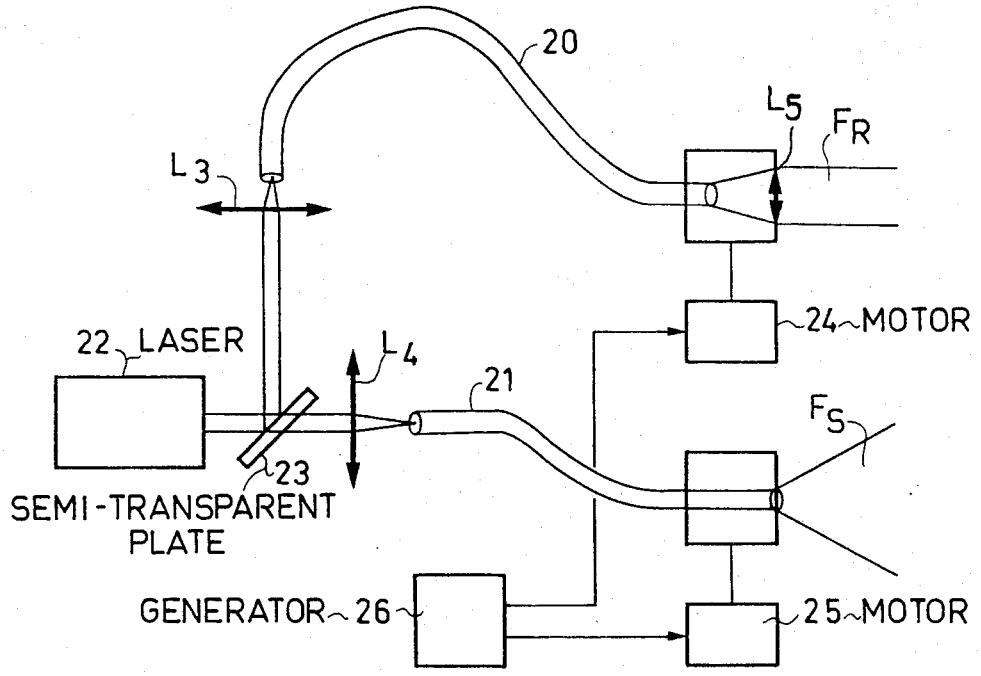
FIG. 4 is a particular aspect of the device according to the invention.

FIG. 4 illustrates this possibility of the displacement of the ends of two monomode optical fibres 20, 21. The light beam from a laser 22 is split into two components by interposing a semitransparent plate 23. After focusing by two lenses $L_3$ and $L_4$ component beams propagate in fibres 20 and 21.

The ends of these two fibres are synchronously displaced by two motors 24, 25 controlled by a generator 26, the component of the beam travelling in fibre 20 being collimated by a lens $L_5$ to give the reference beam $F_R$.

Figure 5:
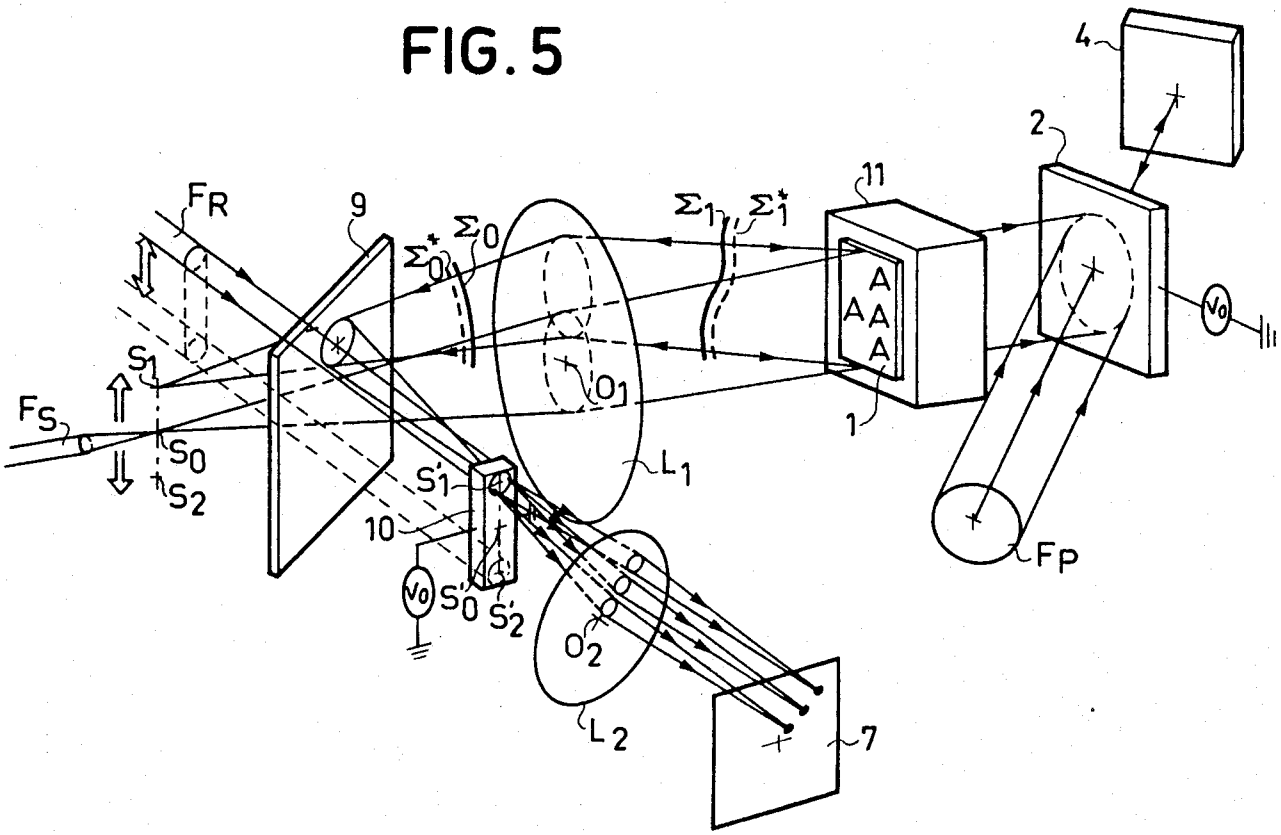
FIG. 5 is another embodiment of the system according to the invention.

A simpler electro-optical configuration is indicated in FIG. 5 In this case source $S_0$ remains fixed and the fictitious translation of $S_0$ from $S_1$ to $S_2$ is obtained by means of an acousto-optical cell 11 which deflects the return beam, which is modulated by the object, e.g. in the object plane. However, then the aberrations induced by $L_1$ are only strictly compensated for point $S'_0$. In addition, fictitious points $S_1$ and $S_2$ are in the vicinity of $S_0$ and it can be taken that the residual distortions induced by lens $L_1$ are small. The displacement of beam $F_R$ must be as in the previous case.

On carrying out this averaging, an integration takes place in the output plane of N images, whose noises are decorrelated. Thus, there is an incoherent integration of N coherent images. The gain on the signal to noise ratio of the correlation peaks is proportional to $\sqrt{N}$.

Another way of improving the signal to noise ratio involves attenuating the low spatial frequencies of the spectrum of the object transparency. This can be obtained by considering a pumping beam $F_P$ of intensity below that of the object beam. Only the high spatial frequencies are then retained in the wave front, which corresponds to a reinforcement of the contours of the object transparency.

As a non-limitative example the optical correlator system of FIG. 2 was produced with a first monocrystalline bismuth silicon oxide plate 2. The area of this plate is $30 \times 30$ mm$^2$, whilst its thickness is 3 mm. The second plate is also a monocrystalline bismuth silicon oxide plate. It has an area of $2 \times 10$ mm$^2$ and a thickness of 1 mm. These plates are polarized with a voltage Vo of approximately 2000 V. The object transparency has a surface area of $25 \times 25$ mm$^2$. If T is the time taken by the point source S to move from $S_1$ to $S_2$, in this case spaced by 5 mm and if $\tau$ is the inscription time of the space charge field in the BSO crystal 10 (bismuth silicon oxide), T is, for example, equal to one second and $\tau$ to 1 millisecond.

In this case it can be considered that over a period of time T there is an incoherent integration of $N = T/\tau$ coherent "images" on detector medium 7. In this case N is equal to 1000. The gain on the signal to noise ratio of the correlation peak is proportional to $\sqrt{N}$, i.e. approximately 30.

Thus, this optical correlator system provides a novel solution to the problems of any correlation device in coherent optics. It permits operation at the limits of the diffraction with reduced quality optical components, particularly with regards to the spherical lens $L_1$. The signal to noise ratio can be made equivalent to that resulting from incoherent illumination.

The use of dynamic materials such as BSO makes it possible to improve the performance of this optical processing system based on the Fourier transform properties of lenses.

The main applications are, for example, in the tracking of targets and in robot technology.

What is claimed is:

1. An optical Fourier transformer device comprising:

a convergent lens;

a coherent radiation point source located at the focal distance from said convergent lens for producing a source beam;

means for positioning a modulating object in the collimated beam emerging from said convergent lens, thereby forming a modulated beam;

a photoexcitable interaction medium having an index of variation which receives the modulated beam and which receives a pumping beam, a plane reflector arranged so as to reflect in normal incidence and towards the said photoexcitable interaction medium the undiffractive radiation emerging from said medium so as to create a diffracted wave emerging from said medium conjugate to said modulated beam, and wherein said convergent lens forms at a Fourier transform plane the Fourier transform of the light incident thereon, a semi-transparent plate positioned between the said point source and said convergent lens for deflecting toward a Fourier transform plane of said convergent lens the radiation contained in the conjugate wave re-radiated by said medium in the direction of said lens.

2. A device according to claim 1, wherein said interaction medium is a monocrystalline bismuth silicon oxide plate.

3. An optical correlator comprising:

(a) a first Fourier transformer device which includes a convergent lens;

a coherent radiation point located at the focal distance from said convergent lens for producing a source beam;

means for positioning modulating objects in the collimated beam emerging from said convergent lens, thereby forming a modulated beam;

a photoexcitable interaction medium having an index of refraction variation which receives the modulated beam and which receives a pumping beam;

a plane reflector arranged so as to reflect in normal incidence and towards the said photoexcitable interaction medium undiffractive radiation emerging from said medium so as to create a diffracted wave emerging from said medium conjugate to said modulated beam, and wherein said convergent lens forms at a Fourier transform plane the Fourier transform of the light incident thereon;

a semi-transparent plate positioned between the said point source and said convergent lens for deflecting towards a Fourier transform plane of said convergent lens the radiation contained in the conjugate wave re-radiated by said medium in the direction of said lens; and (b) a second Fourier transformer device for projecting into an image plane an illumination representing the correlation function of two objects introduced into said first Fourier transformer device.

4. An optical correlator according to claim 3, further comprising:

means for producing a reference beam $F_R$; and angular scanning means for the reference beam $F_R$ for ensuring an optimum diffraction efficiency.

5. An optical correlator according to claim 4, wherein the optical means synchronously ensure the displacement of the source beam and of the reference beam in order to average the optical noise superimposed on this illumination in the image plane.

6. An optical correlator according to claim 4, wherein the source beam and the reference beam emerge from the ends of two monomode optical fibres.

7. An optical correlator according to claim 3, wherein an acousto-optical deflector is interposed to deflect the return beam, which has been modulated by the object.

8. An optical correlator according to claim 3, wherein the interaction medium is a bismuth silicon oxide plate.

* * * * *